US006893097B1

(12) United States Patent
Ebensperger et al.

(10) Patent No.: US 6,893,097 B1
(45) Date of Patent: May 17, 2005

(54) OUTDOOR STOOL SYSTEM

(76) Inventors: Alan H. Ebensperger, 1020 North Shore Dr., Menomonie, WI (US) 54751; Joseph L. Martin, 211 Locust St., Pepin, WI (US) 54759

( * ) Notice: Subject to any disclaimer, the term of this patent is extended or adjusted under 35 U.S.C. 154(b) by 0 days.

(21) Appl. No.: 10/615,225

(22) Filed: Jul. 7, 2003

(51) Int. Cl.[7] ..... A47C 1/12

(52) U.S. Cl. ..... 297/451.4; 297/4; 297/195.11; 297/344.18; 297/16.2

(58) Field of Search ..... 297/451.4, 451.5, 297/4, 195.11, 344.18, 451.2, 440.16, 440.24, 463.2, 16.2

(56) References Cited

U.S. PATENT DOCUMENTS

| | | | | | |
|---|---|---|---|---|---|
| 699,932 | A | | 5/1902 | Smith | |
| 759,809 | A | | 5/1904 | Farley | |
| 3,310,340 | A | * | 3/1967 | Brewer et al. | 297/16.1 |
| 4,098,478 | A | * | 7/1978 | Spitzke | 248/156 |
| 4,101,163 | A | * | 7/1978 | Morin | 297/16.1 |
| 4,232,896 | A | * | 11/1980 | Caldwell | 297/4 |
| 4,266,748 | A | | 5/1981 | Dalton | 248/425 |
| 4,366,981 | A | | 1/1983 | Ziegler et al. | 297/328 |
| 4,433,870 | A | | 2/1984 | Bairen et al. | 294/16 |
| 4,451,080 | A | | 5/1984 | Nix | 297/4 |
| 4,676,547 | A | | 6/1987 | Spillman | 297/4 |
| 4,932,719 | A | * | 6/1990 | Gonzalez y. Rojas | 297/338 |
| D309,989 | S | | 8/1990 | Gotts | D6/364 |
| 5,188,422 | A | | 2/1993 | Montgomery | 297/195 |
| 5,673,966 | A | * | 10/1997 | Morton, Jr. | 297/4 |
| 5,842,742 | A | * | 12/1998 | Hoshino | 297/338 |
| 5,927,797 | A | | 7/1999 | Ferguson | 297/4 |
| 5,954,248 | A | | 9/1999 | Jasper | 224/155 |
| 5,975,635 | A | | 11/1999 | Parpala | 297/338 |
| 6,062,638 | A | * | 5/2000 | Ferguson | 297/4 |
| D428,721 | S | | 8/2000 | Jenkins | D6/364 |
| 6,176,545 | B1 | * | 1/2001 | Hambleton | 297/4 |

OTHER PUBLICATIONS

Knight's Swamp Seat, Jun. 8, 2003, HuntSmart.Com Website, p. 1.

* cited by examiner

*Primary Examiner*—Laurie K. Cranmer

(57) ABSTRACT

An outdoor stool system for providing a portable seating structure capable of being utilized in various ground surface conditions. The outdoor stool system includes an elongate support member, a seat shaft slidably positioned within the support member, a seat member attached to the seat shaft, and a self-deploying base support that has a compact storage structure. The base support is comprised of a spike member along with a first member and a second member pivotally attached to a lower collar. The first member and the second member pivotally extend outwardly when the spike member is inserted into a ground surface thereby providing positional support to the seat structure.

20 Claims, 4 Drawing Sheets

OUTDOOR STOOL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to portable seating devices and more specifically it relates to an outdoor stool system for providing a portable seating structure capable of being utilized in various ground surface conditions.

2. Description of the Related Art

Portable seating devices have been in use for years. Portable seating devices are typically comprised of a foldable structure commonly referred to as the "lawn chair." Conventional lawn chairs are not suitable for transporting over long distances because of their large size even when folded.

Hunters, hikers, bird watchers, fishermen, outdoor enthusiasts and others who travel in the outdoors have a need for a portable and compact seating device. However, current portable seats are not suitable for usage over extended distances and for various types of ground surfaces.

While these devices may be suitable for the particular purpose to which they address, they are not as suitable for providing a portable seating structure capable of being utilized in various ground surface conditions. Conventional seating devices are not suitable for transporting for long distances and are not suitable for usage in various ground surface conditions.

In these respects, the outdoor stool system according to the present invention substantially departs from the conventional concepts and designs of the prior art, and in so doing provides an apparatus primarily developed for the purpose of providing a portable seating structure capable of being utilized in various ground surface conditions.

BRIEF SUMMARY OF THE INVENTION

In view of the foregoing disadvantages inherent in the known types of seating devices now present in the prior art, the present invention provides a new outdoor stool system construction wherein the same can be utilized for providing a portable seating structure capable of being utilized in various ground surface conditions.

The general purpose of the present invention, which will be described subsequently in greater detail, is to provide a new outdoor stool system that has many of the advantages of the seating devices mentioned heretofore and many novel features that result in a new outdoor stool system which is not anticipated, rendered obvious, suggested, or even implied by any of the prior art seating devices, either alone or in any combination thereof.

To attain this, the present invention generally comprises an elongate support member, a seat shaft slidably positioned within the support member, a seat member attached to the seat shaft, and a self-deploying base support that has a compact storage structure. The base support is comprised of a spike member along with a first member and a second member pivotally attached to a lower collar. The first member and the second member pivotally extend outwardly when the spike member is inserted into a ground surface thereby providing positional support to the seat structure.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an outdoor stool system that will overcome the shortcomings of the prior art devices.

A second object is to provide an outdoor stool system for providing a portable seating structure capable of being utilized in various ground surface conditions.

Another object is to provide an outdoor stool system that provides a dry place for an individual to sit when in muddy and swampy conditions.

An additional object is to provide an outdoor stool system that is compact in size and is easily transported.

A further object is to provide an outdoor stool system that utilizes flared feet that automatically deploy themselves when inserted into a ground surface.

Another object is to provide an outdoor stool system that is adjustable in height.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
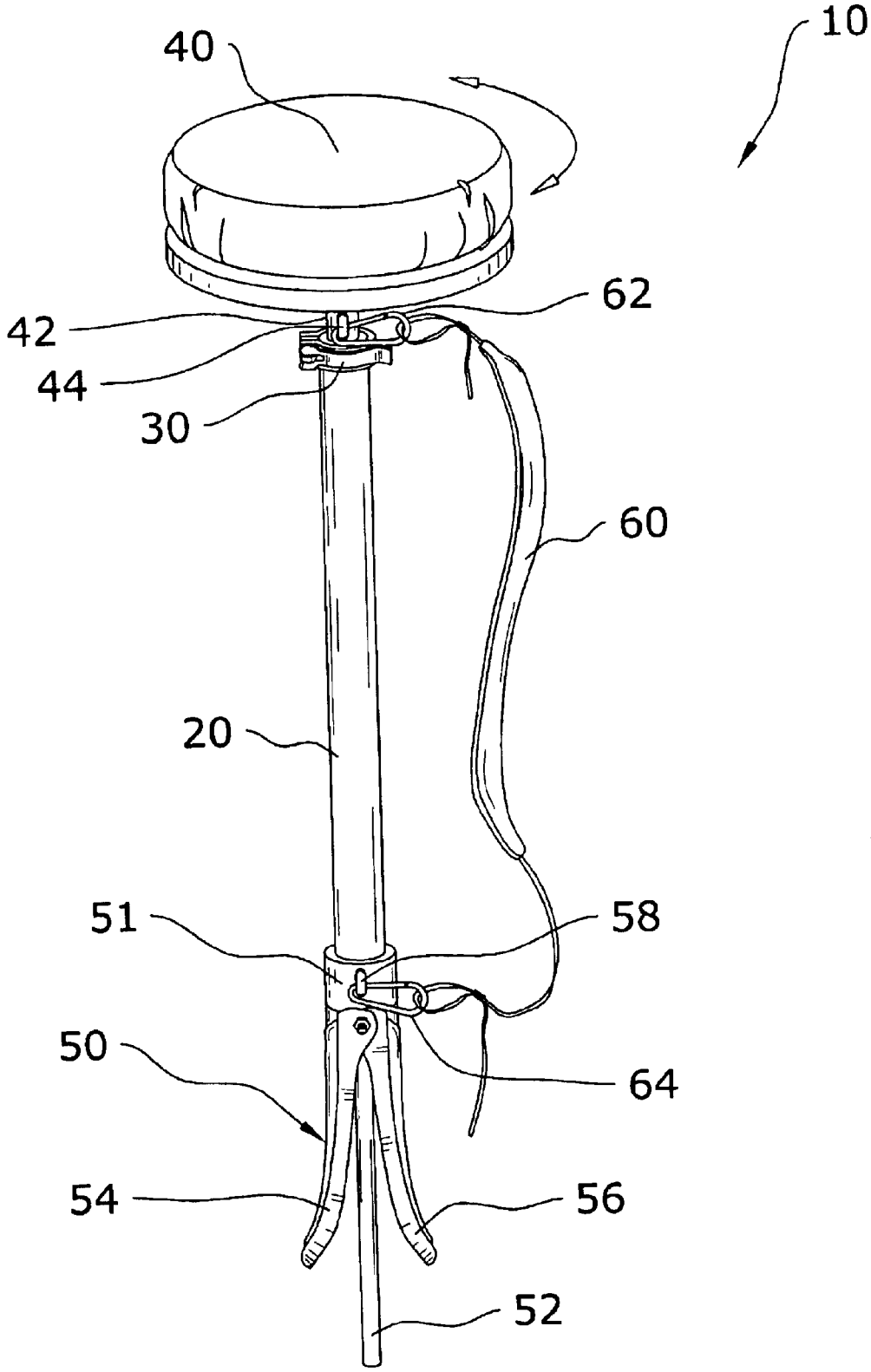
FIG. 1 is an upper perspective view of the present invention.

Turning now descriptively to the drawings, in which similar reference characters denote similar elements throughout the several views, FIGS. 1 through 4 illustrate an outdoor stool system 10, which comprises an elongate support member 20, a seat shaft 42 slidably positioned within the support member 20, a seat member 40 attached to the seat shaft 42, and a self-deploying base support 50 that has a compact storage structure. The base support 50 is comprised of a spike member 52 along with a first member 54 and a second member 56 pivotally attached to a lower collar 51. The first member 54 and the second member 56 pivotally extend outwardly when the spike member 52 is inserted into a ground surface thereby providing positional support to the seat structure.

B. Support Member

As shown in FIGS. 1 through 4 of the drawings, the support member 20 is comprised of an elongate straight structure. The support member 20 has a length sufficient to support an individual at a desired elevation above the ground surface. The support member 20 is preferably a tubular structure, however various other structures may be utilized to construct the support member 20.

C. Seat Shaft

The seat shaft 42 is adjustably and slidably positioned within an upper end of the support member 20 as shown in FIGS. 1 through 4 of the drawings. The upper end of the support member 20 includes an upper opening that slidably receives the seat shaft 42. The seat shaft 42 is comprised of a solid or tubular structure capable of supporting the seat member 40.

D. Locking Collar

The locking collar 30 is attached to the upper end of the support member 20 for locking a position of the seat shaft 42 as shown in FIGS. 1 through 4 of the drawings. The locking collar 30 may be comprised of various well-known locking devices, however, the locking collar 30 is preferably comprised of a simple lever actuated structure that frictionally engages the seat shaft 42 at the desired position.

Various other locking structures may be utilized to secure the position of the seat shaft 42 within the support member 20. In addition, the seat member 40 may be positioned directly upon the support member 20 without using the seat shaft 42.

E. Seat Member

The seat member 40 is attached to an upper portion of the seat shaft 42 as shown in FIGS. 1 through 4 of the drawings. The seat member 40 may be comprised of various well-known seat structures commonly utilized within the seat industry. The seat member 40 may be rotatably or non-rotatably supported upon the seat shaft 42.

F. Base Support

The base support 50 is attached to the lower end of the support member 20 and has a compact storage structure as shown in FIGS. 1 through 4 of the drawings. The base support 50 is comprised of a spike member 52 attached to a lower collar 51, and a first member 54 and a second member 56 pivotally attached to a lower collar 51, wherein the lower collar 51 is attached to a lower end of the support member 20 as shown in FIGS. 1 through 4 of the drawings.

The lower collar 51 is preferably removably attached to the lower end of the support member 20. The lower collar 51 may be secured to the lower end of the support member 20 via conventional fasteners.

Figure 2:
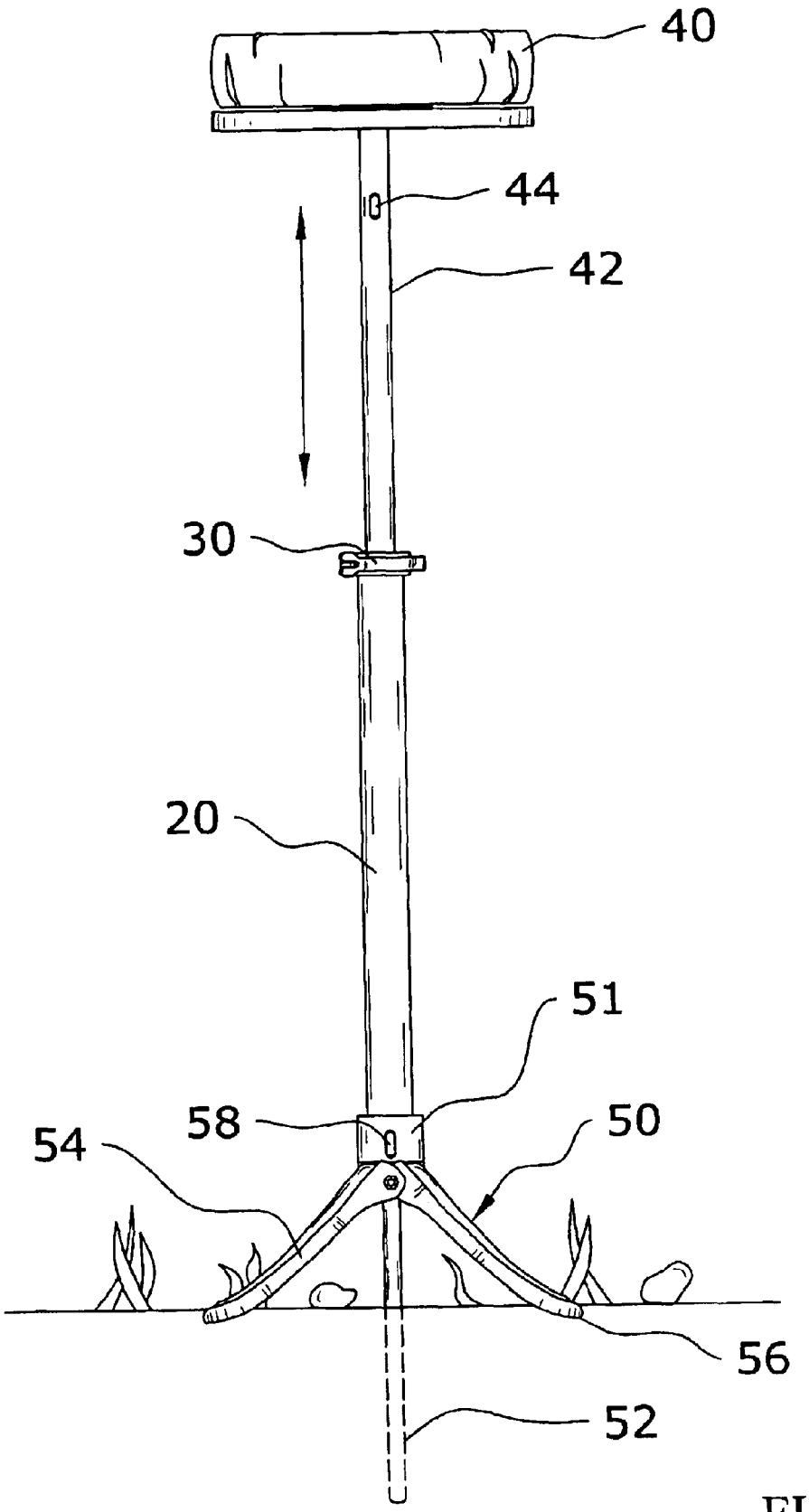
FIG. 2 is a side view of the present invention illustrating the adjustability of the seat.

The first member 54 and the second member 56 each pivot outwardly at an angle with respect to the spike member 52 for supporting the present invention in an upright vertical position as best shown in FIG. 2 of the drawings. The maximum pivot angle of the first member 54 and the second member 56 is preferably less than sixty degrees.

Figure 3:
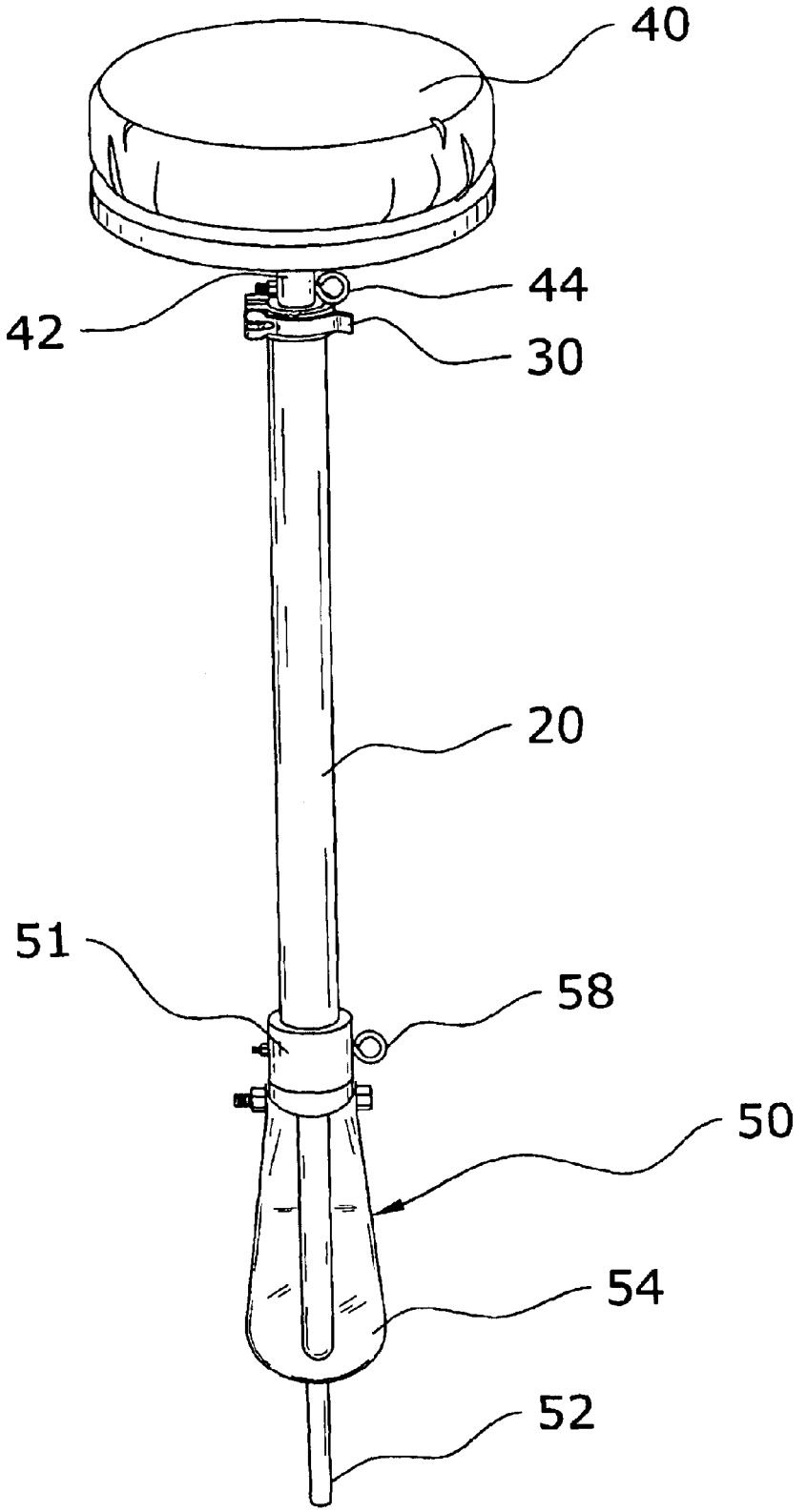
FIG. 3 is an upper perspective view of the present invention.
Figure 4:
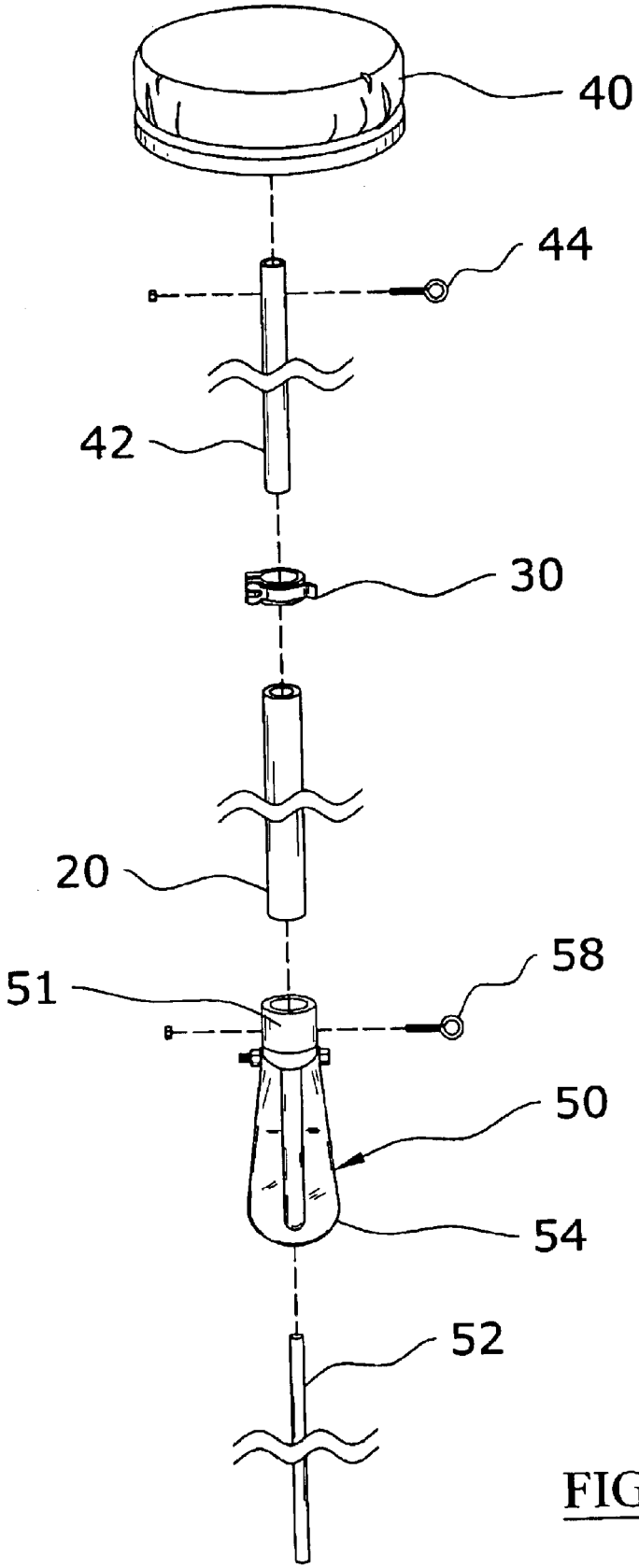
FIG. 4 is an exploded upper perspective view of the present invention.

As shown in FIG. 3 of the drawings, the first member 54 and the second member 56 each have a narrow inner portion near the lower collar 51 and a broad outer portion. The broader outer portion prevents the members 54, 56 from sinking into the ground surface. In addition, the first member 54 and the second member 56 each preferably include a reinforcing rib for adding strength thereto. As shown in FIGS. 1 and 2 of the drawings, the members 54, 56 each are angled upwardly toward the outer portions thereof.

The spike member 52 is comprised of an elongate straight structure as shown in FIGS. 1 through 4 of the drawings. The spike member 52 may have a sharpened or dull lower end. The first member 54 and the second member 56 are foldable substantially parallel with respect to the spike member 52 as shown in FIGS. 1 and 3 of the drawings.

G. Carrying Strap

The carrying strap 60 is removably connectable to the support member 20 as shown in FIG. 1 of the drawings. An upper eyelet 44 is preferably positioned within the seat shaft 42 and a lower eyelet 58 is preferably positioned within the lower collar 51 for receiving the carrying strap 60.

A first clasp 62 and a second clasp 64 upon the carrying strap 60 each engage the upper eyelet 44 and the lower eyelet 58 respectively as shown in FIG. 1 of the drawings. The user is able to position the carrying strap 60 upon their shoulder or other carrying position to transport the present invention.

H. Operation

In use, the user inserts the spike member 52 into the ground surface. As the spike member 52 is inserted into the ground surface the members 54, 56 engage ground surface and expand outwardly as shown in FIG. 2 of the drawings. The user then adjusts the height of the seat member 40 and locks the position via the locking collar 30. The user is thereafter able to sit upon the seat member 40. When finished using the present invention, the user simply removes the spike member 52 from the ground surface and is able to transport the invention to a new location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An outdoor stool system, comprising:

a support member;

a seat shaft adjustably positioned within an upper end of said support member;

a locking collar attached to said upper end of said support member for locking a position of said seat shaft;

a seat member attached to said seat shaft; and a base support attached to said support member that has a compact storage structures wherein said base support is comprised of a spike member attached to a lower collar, and a first member and a second member pivotally attached to said lower collar, wherein said lower collar is attached to a lower end of said support member.

2. The outdoor stool system of claims 1, wherein said lower collar is removably attached to said lower end of said support member.

3. The outdoor stool system of claims 1, wherein said first member and said second member each pivot outwardly at an angle with respect to said spike member.

4. The outdoor stool system of claim 3, wherein said angle is less than sixty degrees.

5. The outdoor stool system of claim 1, wherein said first member and said second member each have a narrow inner portion and a broad outer portion.

6. The outdoor stool system of claim 5, wherein said first member and said second member each include a reinforcing rib.

7. The outdoor stool system of claims 1, wherein said spike member is comprised of an elongate straight structure.

8. The outdoor stool system of claim 1, wherein said first member and said second member are foldable substantially parallel with respect to said spike member.

9. The outdoor stool system of claim 1, wherein said support member is an elongate straight structure.

10. An outdoor stool system, comprising:

a support member;

a seat shaft adjustably positioned within an upper end of said support member;

a locking collar attached to said upper end of said support member for locking a position of said seat shaft;

a seat member attached to said seat shaft;

a base support attached to said support member that has a compact storage structure, wherein said base support is comprised of a spike member attached to a lower collar, and a first member and a second member pivotally attached to said lower collar, wherein said lower collar is attached to a lower end of said support member;

a carrying strap removably connectable to said support member.

11. The outdoor stool system of claim 10, wherein said lower collar is removably attached to said lower end of said support member.

12. The outdoor stool system of claim 10, wherein said first member and said second member each pivot outwardly at an angle with respect to said spike member.

13. The outdoor stool system of claim 12, wherein said angle is less than sixty degrees.

14. The outdoor stool system of claim 10, wherein said first member and said second member each have a narrow inner portion and a broad outer portion.

15. The outdoor stool system of claim 14, wherein said first member and said second member each include a reinforcing rib.

16. The outdoor stool system of claim 10, wherein said spike member is comprised of an elongate straight structure.

17. The outdoor stool system of claim 10, wherein said first member and said second member are foldable substantially parallel with respect to said spike member.

18. The outdoor stool system of claim 10, wherein said support member is an elongate straight structure.

19. An outdoor stool system, comprising:

a support member, wherein said support member is an elongate straight structure;

a seat shaft adjustably positioned within an upper end of said support member;

a locking collar attached to said upper end of said support member for locking a position of said seat shaft;

a seat member attached to said seat shaft;

a base support attached to said support member that has a compact storage structure, wherein said base support is comprised of:

a spike member extending from a lower end of said support member, wherein said spike member is comprised of an elongate straight structure; and a first member and a second member pivotally attached to a collar attached to said lower end of said support member;

wherein said first member and said second member each pivot outwardly at an angle with respect to said spike member;

wherein said angle is less than sixty degrees;

wherein said first member and said second member each have a narrow inner portion and a broad outer portion;

wherein said first member and said second member are foldable substantially parallel with respect to said spike member.

20. The outdoor stool system of claim 19, wherein said first member and said second member each include a reinforcing rib.

* * * * *